United States Patent [19]

Peppers

[11] 4,424,699

[45] Jan. 10, 1984

[54] TUBE BENDER CONSTRUCTION

[75] Inventor: Henry J. Peppers, Rolling Meadows, Ill.

[73] Assignee: Imperial Clevite Inc., Rolling Meadows, Ill.

[21] Appl. No.: 235,026

[22] Filed: Feb. 17, 1981

[51] Int. Cl.[3] ..... B21D 11/04

[52] U.S. Cl. ..... 72/388; 72/459

[58] Field of Search ..... 72/388, 459, 457, 458, 72/487, 217, 36, 32, 34, 35, 149

[56] References Cited

U.S. PATENT DOCUMENTS

| | | | |
|---|---|---|---|
| 2,381,064 | 8/1945 | Lewin | 72/459 |
| 2,732,742 | 1/1956 | Lewin | 72/459 |
| 2,796,785 | 6/1957 | Philippe | 72/388 |
| 2,887,917 | 5/1959 | Kowal | 72/388 |
| 3,194,038 | 7/1965 | Small | 72/459 |
| 3,380,283 | 4/1968 | Wilson | 72/459 |
| 3,416,345 | 12/1968 | Stanley | 72/459 |
| 3,750,447 | 8/1973 | Kowal | 72/388 |
| 3,926,028 | 12/1975 | Kowal | 72/388 |

*Primary Examiner*—Gene P. Crosby

*Attorney, Agent, or Firm*—Wood, Dalton, Phillips, Mason & Rowe

[57] ABSTRACT

A tube bender construction for manual operation in bending a tube. The tube bender includes a mandrel defining a bending groove into which the tube is urged by a forming member mounted to the mandrel to swing about a bending axis of the bending groove. The tube to be bent is held against longitudinal movement during the bending operation by a tube holding member. Movement of the forming member about the bending axis is effected by manipulation of a pair of handles. The tube holding member is selectively retained in a retracted position spaced from the tube-retaining disposition by cooperating movement limiting structure on the tube holding member and structure in fixed association with the mandrel.

9 Claims, 5 Drawing Figures

Fig. 4.
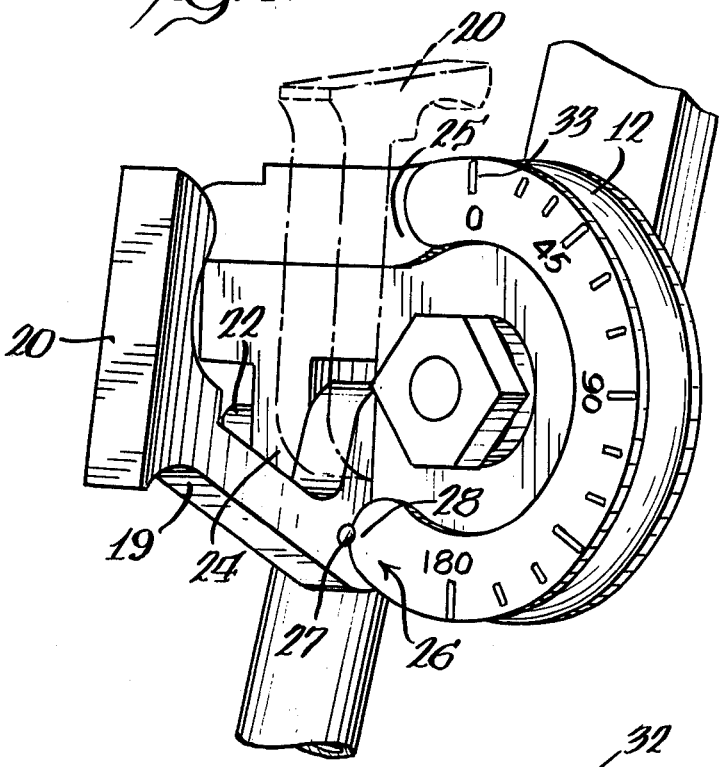
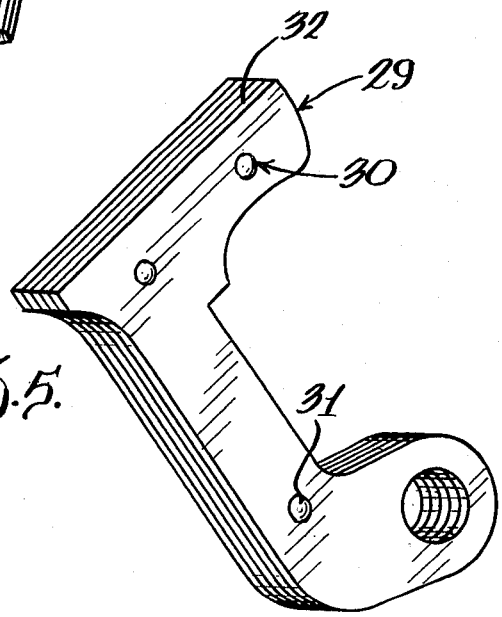
Fig. 5.

TUBE BENDER CONSTRUCTION

BACKGROUND OF THE INVENTION

1. Field of the Invention

This invention relates to tube benders and in particular to manually operable tube benders wherein a forming member is swung about a mandrel bending axis by means of a handle associated therewith and a handle mounted to the mandrel.

2. DESCRIPTION OF THE BACKGROUND ART

Manually operable tube benders are well known in the art. One improved form of such tube bender is illustrated in U.S. Pat. No. 2,796,785 of Howard L. Philippe. As shown therein, a shoe forming member is provided with a handle. The shoe is swingably mounted to a mandrel for pivotal movement about a bending axis. A second handle is connected to the mandrel. A hook is swingably mounted on the second handle for engaging the tube at a point adjacent the bend start point of a groove in the periphery of the mandrel into which the tube is urged in the bending operation.

Further improved tube benders are illustrated in U.S. Pat. No. 2,887,917 and 3,926,028 of Leonard J. Kowal. In U.S. Pat. No. 2,887,917, a tube bender is illustrated wherein the handle connected to the mandrel is provided with an offset and improved scale means are provided on the mandrel for indicating the extent of the formed bend.

In Kowal U.S. Pat. No. 3,926,028, the tube bender is provided with a vise mounting portion in lieu of the handle secured to the mandrel. In one form, the hook is formed integrally with the male clamp portion, and in a second form, the hook is pivotally mounted thereon.

In U.S. Pat. No. 3,750,447 of Leonard J. Kowal and William R. Saddler, a further improved tube bender is illustrated having fixed hook means with a cutout space being provided in confrontation to the hook to permit facilitated installation of the tube to be bent into the tool, notwithstanding the fixed relationship of the hook to the mandrel.

SUMMARY OF THE INVENTION

The present invention comprehends an improved tube bender having means for automatically positioning the tube retaining member in a retracted disposition so as to permit facilitated placement of the tube to be bent in the bending tool and removal of the bent tube therefrom.

In the illustrated embodiment, the tube retaining member comprises a hook pivotally mounted in association with the mandrel so as to dispose a tube engaging portion thereof with the tube in a tube holding disposition. The hook is swingable from the tube holding disposition to a retracted disposition providing the desired facilitated installation and removal of the tube.

The invention comprehends the provision of cooperating means on the tube retaining member and fixed means associated with the mandrel for limiting the swinging movement of the hook to a preselected retracted disposition which, while spaced from the tube holding position, is disposed for facilitated return of the hook to the tube holding position after a new tube to be bent is placed in the bending tool.

In the illustrated embodiment, the cooperating means for limiting the pivotal movement of the tube retaining member comprises projection means on the tube retaining member and a stop surface fixedly associated with the mandrel abutted by the projection means in the retracted disposition of the tube retaining member.

In the illustrated embodiment, the stop shoulder associated with the mandrel comprises an edge portion of the mandrel in the path of movement of the projection on the tube retaining member.

In the illustrated embodiment, the tube retaining member comprises a hook.

In the illustrated embodiment, the tube retaining member comprises a laminated structure wherein the several portions of the structure are retained in association with each other by securing means. In the illustrated embodiment, a portion of the securing means defines the cooperating shoulder means for limiting the pivotal movement of the tube retaining member.

More specifically, in the illustrated embodiment, the laminated structure is secured by rivet securing means and the cooperating stop means on the tube retaining member comprises rivet head means.

In the illustrated embodiment, the hook member is pivotally mounted to the mandrel adjacent the portion of the mandrel defining the motion limiting means cooperating with the projection on the hook member.

Thus, the tube bender construction of the present invention provides an improved controlled hook member disposition which is extremely simple and economical of construction while yet providing the highly improved features discussed above.

BRIEF DESCRIPTION OF THE DRAWING

Other features and advantages of the invention will be apparent from the following description taken in connection with the accompanying drawing wherein:

FIG. 4 is a fragmentary perspective view illustrating the arrangement of the tube retaining member in the retracted disposition; and FIG. 5 is a perspective view of a laminated tube retaining member wherein the securing means thereof defines the motion limiting means thereon.

DESCRIPTION OF THE PREFERRED EMBODIMENT

Figure 1:
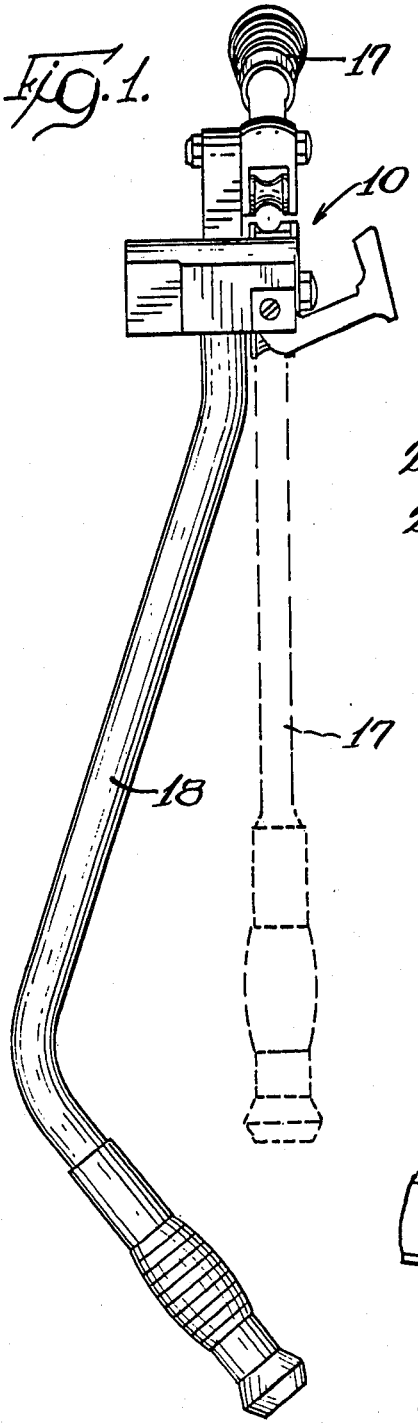
FIG. 1 is an elevation of a tube bender embodying the invention.

In the exemplary embodiment of the invention as disclosed in the drawing, a manually operable tube bender generally designated 10 is shown to include a mandrel 11 defining an annular peripheral bending groove 12. A tube to be bent T is bent into the forming groove by a forming member 13 which is swung about a bending axis 14 of the groove 12 by its connection to the mandrel through a link 15. The tube to be bent is held against longitudinal movement during the bending operation by a holding means generally designated 16.

Movement of the forming member 13 about axis 14 is effected by suitable manipulation of a pair of handles 17 and 18 connected respectively to the forming member 13 and mandrel 11.

The holding means 16 herein comprises a hook member 19 having a tube retaining portion 20 and a pivotal mounting portion 21. The pivotal mounting portion is pivotally mounted in the tube bender as by means of a pivot screw 22. A friction washer 23 may be provided between the hook member 19 and mandrel portion 24 for providing controlled pivotal swinging of the hook.

Figure 2:
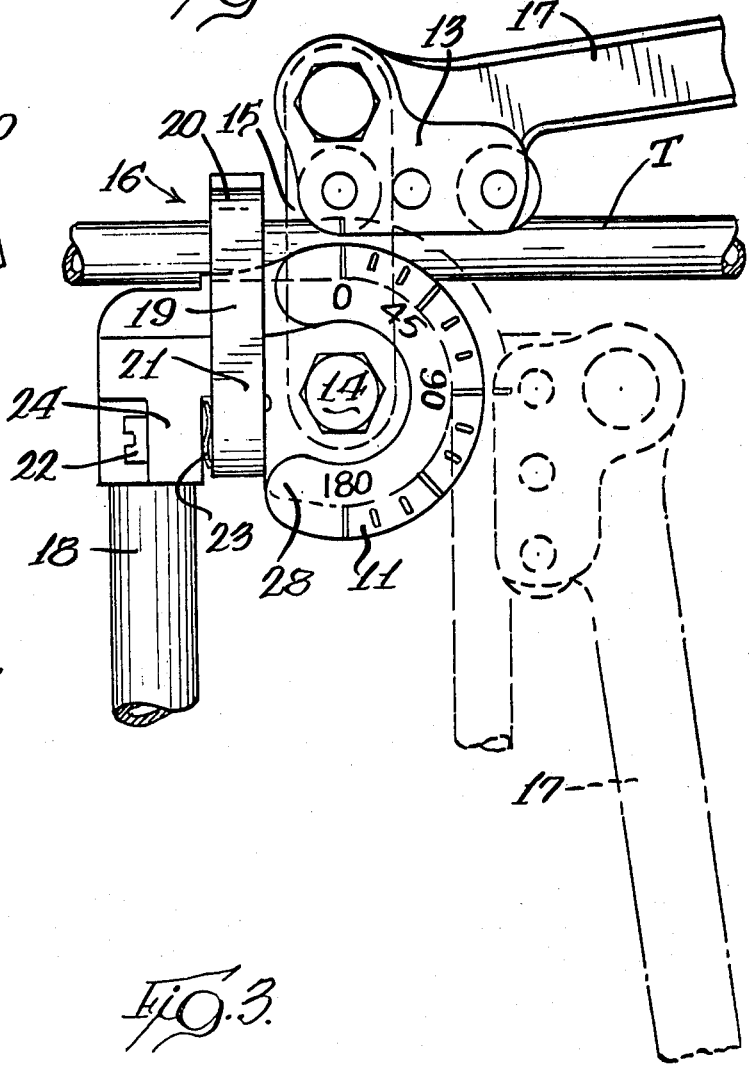
FIG. 2 is a fragmentary side elevation thereof with the forming member shown in a 90° bend position in broken lines.
Figure 3:
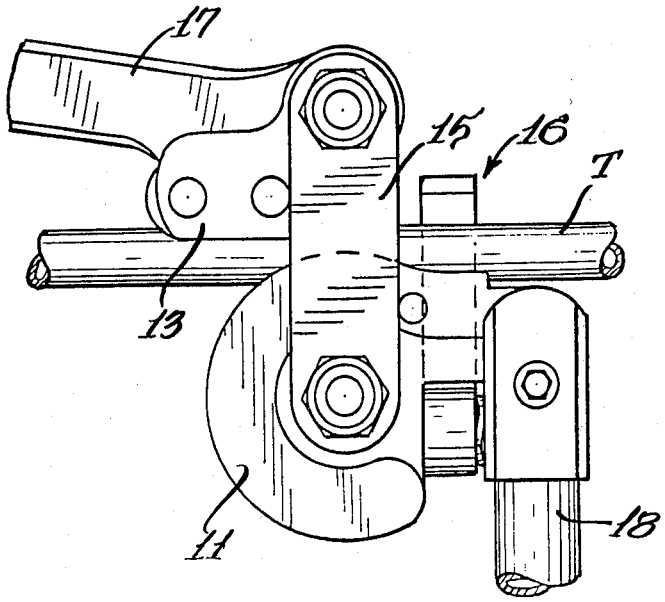
FIG. 3 is a fragmentary rear elevation thereof.

Referring more specifically to FIG. 4, the tube retaining portion 20 is disposed in a tube engaging position, as shown in broken lines therein, by the swinging of the hook member into abutment with a second portion 25 of the mandrel at one end of the bending groove 12. As shown in FIG. 2, when the hook is swung to the tube engaging disposition, the tube engaging portion 20 engages the tube to lock it against longitudinal displacement during the bending operation wherein the forming member 13 is moved arcuately about axis 14 to bend the tube T into the bending groove 12.

The invention comprehends the provision of means for limiting the swinging movement of the hook away from the tube engaging disposition to a retracted disposition, such as shown in full lines in FIG. 4. More specifically, the invention comprehends the provision of cooperating means 26 for limiting the pivotal movement of the hook member away from the tube engaging disposition. More specifically, in the illustrated embodiment, the pivotal movement limiting means comprises a projection 27 on the hook and a stop shoulder 28 on the mandrel disposed to limit the pivotal movement of the hook to a position wherein the tube engaging portion 20 is spaced from the tube holding position but retained adjacent thereto for facilitated return thereof into tube engaging disposition when a tube to be bent is again placed in the mandrel groove 12 in the manner illustrated in FIG. 2.

The stop surface provided in fixed relationship to the mandrel, in the illustrated embodiment, comprises an edge portion of the mandrel.

The invention further comprehends the provision of an improved hook member generally designated 29 comprising a multipart structure with securing means generally designated 30 for securing the multipart structure together to define a unitary hook member 29. The invention comprehends that a portion of the securing means, illustrated in FIG. 5 as securing element 31, define a projection for cooperation with the mandrel surface portion 28 in limiting the pivotal movement of the tube retaining hook member.

More specifically, as illustrated in FIG. 5, the hook member may comprise a laminated structure formed of a plurality of formed sheets 32 secured together by the securing means 30 illustratively comprising a plurality of rivets. Thus, in the embodiment of FIG. 5, projection 31 comprises rivet head means, thereby functioning both as means for securing the multipart tube retaining member as an assembled structure and as a portion of the pivotal movement limiting means of the tube bender.

In the embodiment of FIG. 4, the projection 27 may be formed integrally with the hook member 19. Where the hook member comprises a casting, the projection may be formed as a cast portion thereof. Alternatively, where the hook member is machined, the projection may be machined from the stock forming the hook member.

The projection is urged into association with the mandrel portion 28 by the friction washer 23 tending to urge the hook toward the mandrel portion 28, as illustrated in FIG. 2. Thus, the friction washer 23 defines means for controlling the swinging movement of the hook member as well as means for biasing the projection portion of the cooperating motion limiting means to the desired relationship with the stop surface on the mandrel.

In the illustrated embodiment, the hook is disposed somewhat less than 90° from the tube engaging disposition. Thus, the tube engaging portion 20 is spaced sufficiently from the tube engaging disposition to permit facilitated introduction and removal of the tube relative to the mandrel, while yet disposing the tube engaging portion suitably for facilitated movement into tube engaging disposition upon subsequent installation of a tube in the bending tool, as illustrated in FIG. 2.

In use, the operator installs the tube T in the tube bender, as illustrated in FIG. 2, with the tube extending tangentially to the bending groove 12 at a bend start point 33. The hook 19 is swung into engagement with the tube to retain the tube against longitudinal movement during the bending operation. During the installation of the tube, handle 17 is swung in a counterclockwise direction from the position of FIG. 2 to space the forming means 13 from the mandrel, permitting facilitated installation of the tube T. The handle 17 is then swung in a clockwise direction to the full line position of FIG. 2. Suitable manipulation of handles 17 and 18 is then effected to move the forming member 13 circumferentially about the mandrel to effect a bending of the tube into the groove 12 to the desired angular extent.

As indicated above, hook 19 is swung into engagement with the tube from the retracted position illustrated in full lines in FIG. 4 so that facilitated locking of the tube to be bent is obtained. Upon completion of the bending operation, the bent tube is readily removed from the tube bending tool by the movement of the forming member away from the mandrel and the swinging of the hook 19 to the retracted disposition of FIG. 4.

The foregoing disclosure of specific embodiments is illustrative of the broad inventive concepts comprehended by the invention.

I claim:

1. In a tube bender having a mandrel defining a peripheral arcuate bending groove, and means swingable about the mandrel to urge a tube to be bent into said groove to effect an arcuate bend in the tube, the improvement comprising:

a tube retaining member having a mounting portion pivotally mounted in said tube bender, and a tube engaging portion adapted to engage the tube to be bent in a tube retaining disposition to prevent longitudinal movement of the tube during a tube bending operation, said tube engaging portion being movable from said tube retaining disposition to first and second retracted positions for facilitating placement of said tube to be bent in the tube bender prior to the bending operation, and removal thereof from the tube bender upon completion of the bending operation, a projection on said tube retaining member a stop shoulder on said mandrel adjacent said bending groove, said projection extending parallel to the axis of pivoting of the tube retainer member; and means for resiliently urging said mounting portion of the tube retaining member to a disposition wherein said projection moving in an arcuate path about the pivot axis of the tube retaining member is intercepted by said stop shoulder as an incident of pivotal movement of the tube retaining member being swung to the first retracted position whereby retractive movement of said tube retaining member is yieldingly limited to said first retracted position, said resilient urging means permitting said projection to be urged past said stop shoulder away from said tube retaining disposition into an end of said bending groove in the second retracted position whereby pivotal movement is releasably constrained by the projection in said bending groove in the second retracted position.

2. The tube bender of claim 1 wherein said stop shoulder surface is positioned to be abutted by said projection in said first retracted position of the tube retaining member.

3. The tube bender of claim 1 wherein said stop shoulder comprises an edge portion of said mandrel positioned to be abutted by said projection in said first retracted position of the tube retaining member.

4. In a tube bender having a mandrel defining a peripheral arcuate bending groove and means swingable about the mandrel to urge a tube to be bent into said groove to effect an arcuate bend in the tube, the improvement comprising a tube retaining member having a mounting portion pivotally mounted in said tube bender, and a tube engaging portion adapted to engage the tube to be bent in a tube retaining disposition to prevent longitudinal movement of the tube during a tube bending operation, said tube engaging portion being movable from said tube retaining disposition to a retracted position for facilitating placement of said tube to be bent in the tube bender prior to the bending operation, and removal thereof from the tube bender upon completion of the bending operation, said tube retaining member comprising a multipart structure and securing means for securing the multipart structure together to define a unitary member, said securing means and mandrel defining cooperating means for limiting pivotal movement of the tube retaining member away from said tube retaining disposition to said retracted position.

5. The tube bender of claim 4 wherein said securing means comprises rivet means and said cooperating means comprising rivet head means.

6. The tube bender of claim 4, wherein said tube retaining member comprises a laminated structure and said securing means comprises securing elements extending therethrough.

7. The tube bender of claim 4 wherein said tube retaining member comprises a hook member.

8. The tube bender of claim 4 wherein said mounting portion of the tube retaining member is pivotally mounted to said mandrel.

9. The tube bender of claim 4 wherein said mounting portion of the tube retaining member is pivotally mounted to said mandrel adjacent said cooperating pivotal movement limiting means of the mandrel.

* * * * *